US009695015B1

(12) United States Patent
Marinelli

(10) Patent No.: US 9,695,015 B1
(45) Date of Patent: Jul. 4, 2017

(54) ELEVATOR DOOR SAFETY LOCK SYSTEM

(76) Inventor: James Marinelli, Coral Springs, FL (US)

( * ) Notice: Subject to any disclaimer, the term of this patent is extended or adjusted under 35 U.S.C. 154(b) by 1679 days.

(21) Appl. No.: 12/069,019

(22) Filed: Feb. 6, 2008

Related U.S. Application Data

(63) Continuation-in-part of application No. 11/319,674, filed on Dec. 28, 2005, now abandoned.

(51) Int. Cl.
*B66B 13/16* (2006.01)
*B66B 13/24* (2006.01)
*B66B 1/40* (2006.01)

(52) U.S. Cl.
CPC ..... *B66B 13/16* (2013.01); *B66B 13/165* (2013.01); *B66B 1/40* (2013.01); *B66B 13/245* (2013.01)

(58) Field of Classification Search
USPC ..... 187/331, 335, 390, 391, 393
See application file for complete search history.

(56) References Cited

U.S. PATENT DOCUMENTS 2,375,435 A 5/1945 Muller
4,685,537 A * 8/1987 Kappenhagen ..... 187/316
5,682,024 A * 10/1997 Koopman et al. ..... 187/394
5,894,911 A 4/1999 Bozorgzadeh et al.
5,918,705 A * 7/1999 Friend ..... 187/335
6,006,866 A 12/1999 Horne et al.
6,116,381 A 9/2000 Jalbert
2004/0231928 A1* 11/2004 Azpitarte ..... 187/316
2005/0039987 A1 2/2005 Redden
2005/0098389 A1 5/2005 Martin

FOREIGN PATENT DOCUMENTS

WO WO 2004013030 A1 * 2/2004 ..... B66B 13/00

* cited by examiner

*Primary Examiner* — William A Rivera
*Assistant Examiner* — Stefan Kruer
(74) *Attorney, Agent, or Firm* — Malin Haley DiMaggio & Bowen, P.A.

(57) ABSTRACT

An elevator door safety lock system ensures that an elevator door remains securely closed when it is not aligned with one of a plurality of floor openings. The safety lock system includes a vertical position sensor which includes an RFID reader disposed on the elevator and a plurality of RFID tags each disposed in the shaft at a different floor opening. The reader identifies when it is aligned or non-aligned with any tag indicating when the elevator is aligned and non-aligned with a floor opening. A control unit communicates with the safety lock system and an elevator controller. A door monitor indicates if the elevator door is open or closed and an engagement sensor detects whether the door lock is engaged.

8 Claims, 3 Drawing Sheets

ELEVATOR DOOR SAFETY LOCK SYSTEM

CLAIM OF PRIORITY

The present application is a Continuation-In-Part application which claims priority to pending patent application having Ser. No. 11/319,674, filed on Dec. 28, 2005 now abandoned incorporated herein by reference.

BACKGROUND OF THE INVENTION

Field of the Invention

The present invention relates to an elevator door safety lock system which is configured to safely and effectively lock the doors of an elevator when it is not properly aligned at a designated floor opening. In particular, the elevator door safety lock system provides for effective, safe and secure operation even during power failures and within the crammed and often dirty elevator shaft environment, all in a manner which is substantially easy to ensure effective installment and operation.

Description of the Related Art

An important safety characteristic associated with the operation of nearly all elevators is ensuring that the elevator doors do not open at inappropriate location in the hoistway. In particular, safety evaluations over the years have concluded that in order to preserve maximum safety to the occupants of an elevator, it is imperative that the elevator doors remain in a closed position whenever the elevator is not properly aligned with a floor opening at which safe ingress and egress can be achieved. This includes during travel of the elevator between floor openings, as well as in a situation where an elevator gets stuck between floors, as substantial hazards can occur if occupants of an elevator attempt to open the doors and/or exit the elevator at inappropriate location within the hoistway. Of course, it is understood that for emergency circumstances, any safety lock system must be capable of being exteriorly released, such as during a rescue procedure, however, that release should ultimately be achieved only from the exterior of the car by rescue personnel who have ensured that it is safe for the doors to be opened and for the occupants to be evacuated, or only under controlled or limited circumstances from within the elevator car.

In order to achieve this important safety measure, there have been a variety of different locks and latches developed over the years in order to maintain the elevator door is secure. A substantial drawback associated with these existing latching systems, however, relates to the potential for significant malfunction if power is interrupted to the lock mechanism, such as during a power outage. For example, traditional safety latches are configured to be either closed or open when energized, and to move to an opposite state when de-energized. As a result, if the power to the locking system should be cut for any reason, the door lock will automatically revert to the de-energized state, which in most cases involves unlocking the elevator doors. As can be appreciated, if the cause for an elevator malfunction, such as being trapped between floor openings is a result of a power outage, that very same power outage would also result in counteraction of a primary safety measure associated with the operation of the elevator. Further, even though entirely mechanical locking mechanisms may be employed, with today's modern technology it is generally preferred that appropriate sensors be incorporated into the locking mechanism such that a central control is able to recognize if the doors are locked or unlocked, as well as various other safety checks. Accordingly, for these reasons it would be highly beneficial to provide an elevator door safety lock system which is not subject to power failures or power outages allowing for the doors to open, thus potentially leading to a hazardous situation.

In addition to the above recited difficulties associated with lock malfunctions as a result of power interruption or power outages, another significant concern associated with existing elevator door locking systems relates to wear and tear of the locking mechanism. Specifically, because those locking systems must necessarily be maintained in an energized state for extended periods of time, the mechanism will wear at a much more rapid pace than may be ideal, thus resulting in potentially hazardous malfunctions, or necessitating frequent repairs and/or maintenance checks. Accordingly, it would be beneficial to provide a safety door lock system which securely locks the door with a mechanism that is not only safe and secure, but which will also have a long life and reduced potential for malfunction.

Still another difficulty associated with existing locking systems relates to malfunctions in recognizing when the elevator is properly aligned with a floor opening. In particular, many existing door locking systems determine proper alignment by incorporating a contact type system which tells the door lock when the elevator is properly aligned with a floor opening because a physical contact is made. Unfortunately, such contact systems, while not generally susceptible to malfunction as a result of power interruptions or power outages, are subject to significant wear over time, and as a result of friction, dirt, corrosion, and normal debris or oil/lubricants that may be present in the elevator shaft and can interfere with the contact. As a result, in order to ensure that the locking system will ultimately function properly, frequent cleaning and/or changing of the contacts is typically required, especially as a result of the wear characteristic resulting from continuous contacting and uncontacting. Moreover, although some in the industry have attempted to utilize visual indicators of the elevator's positioning, it has been seen that those visual indicators are also susceptible to power outages or power interruptions, especially due to the power requirements associated with the LEDs or electric eyes that typically comprise such visual sensors, but more so because visual sensors are especially susceptible to dirt and grime within the elevator shaft which may occlude lenses, lights and/or markings. As a result, it would be highly beneficial to provide a vertical position sensor which is configured in such a manner that it does not require the strong continuous power source that would be susceptible to power outages or power malfunctions, and which is also configured in a manner whereby it can operate for extended periods of time without repair, replacement or cleaning, and is minimally, if at all susceptible to the dirty or grimy operating environment typically associated with the interior of an elevator shaft.

SUMMARY OF THE INVENTION

The present invention is directed toward an elevator system, and in particular an elevator door safety lock system, to be integrated therewith. In particular, the elevator system, as with typical elevators, includes a shaft having a plurality of floor openings. Riding within the shaft is an elevator car that effectively moves between the floor openings for the loading or unloading of passengers or cargo. Furthermore, a door is provided on at least one face of the elevator, the door opening when the elevator is properly aligned with a floor opening.

Further included within the present elevator system is a vertical position sensor. In particular, the vertical position sensor preferably includes a radio frequency identification or RFID reader that is disposed on the elevator, and preferably at least one or more RFID tags disposed in the shaft to correspond to at least one but preferably each of the floor openings. The vertical position sensor is configured to identify the position of the elevator within the shaft, and in the preferred embodiment whereby the vertical position sensor includes the RFID reader and RFID tags, the reader is structured to identify when the tag is disposed within a predefined proximity thereto so as to effectively determine when the elevator is aligned and non-aligned with the floor opening.

In order to maintain the door securely locked when the elevator is not aligned with one of the floor openings, a door lock is further provided. In particular, the door lock includes preferably a socket and a latch pin, wherein the latch pin is structured to move between an engaged and a disengaged orientation relative to the socket. With the door lock properly and operatively associated with the elevator door, the door will be maintained in a closed position when the latch pin is in its engaged orientation relative to the socket, but can open when it is not.

The door lock also preferably includes an engager. The engager preferably has a first state and a second state, with its first state structured to maintain the latch pin in its engaged orientation relative to the socket, and its second state structured to maintain the latch pin in its disengaged orientation relative to the socket. Furthermore, the engager is specifically structured to remain in its current state until receipt of an input. As a result, when in the first state the engager will remain in that first state until an input is received, and similarly when in its second state it will remain in the second state until an input is received.

The vertical position sensor is preferably operatively associated with the door lock and is structured to cause the input to be communicated to the engager at least when the door is aligned with the door opening. Further, the vertical position sensor is also preferably structured to communicate an input to the engager when the door becomes non-aligned with the floor opening. As a result, when the door becomes non-aligned with the floor opening the input is provided such that the engager is in its first state, and when the door is aligned with the floor opening the input is provided to place the engager in its second state. In this manner, the elevator is effectively secured if it is moving or if it is stuck between floor openings, but is unlocked such that the doors may open when proper alignment with a floor opening is maintained, these states being achieved without risk that a power outage or power interruption will cause an unwanted change of state at an inopportune time.

In another embodiment, the elevator door safety lock system includes a control unit structured to coordinate activity of the system, and a power supply which provides voltage and current for operation of the system. More specifically, the control unit is structured to send signals and/or instructions to, and receive signals and/or information from, both the RFID reader and the door lock. The control unit is also in communication with an elevator controller. As such, the control unit is capable of coordinating activities of the elevator door safety lock system in cooperation with the elevator controller, which otherwise controls the operation of the elevator system.

The elevator door safety lock system also includes an engagement sensor in communication with the control unit and structured to detect whether the door lock is in a locked or unlocked state. Accordingly, the control unit can signal to the elevator controller whether the elevator door is locked or unlocked.

The system also includes a release capability in communication with the control unit and structured to permit selectable release of the door lock. By way of example, in one embodiment, the release capability comprises a momentary button switch which is pressed to activate the release of the door lock. The release capability can be located in a variety of locations on, in, or about the elevator car, and can be used, for example, during inspections when the elevator is disposed between landings.

The system further comprises a door monitor in communication with the control unit, structured to monitor and signal whether the elevator door is open or closed. This signal can be used to confirm the door open/closed status provided by a separate gate switch signal received by the elevator controller.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
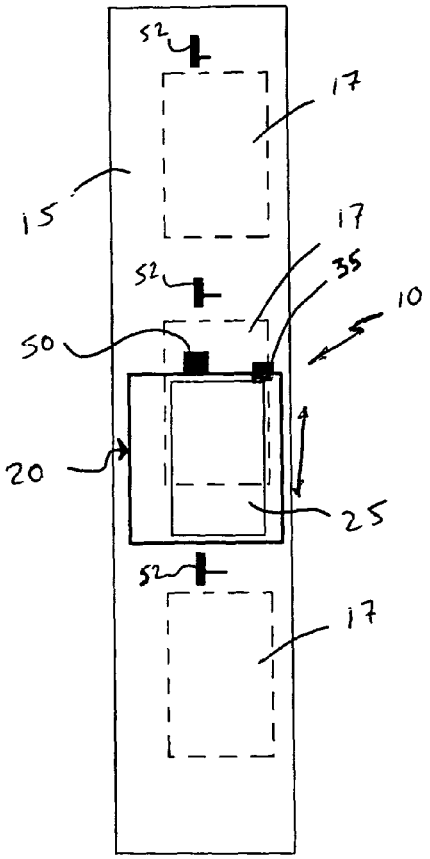
FIG. 1 is an illustration of an elevator system of the present invention incorporating the preferred elevator door safety lock system.
Figure 2:
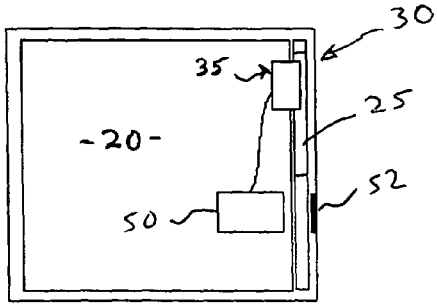
FIG. 2 is an isolated view of a preferred vertical position sensor of the present invention.

Shown throughout the figures, the present invention is directed to a safer and more secure elevator system, generally indicated as 10, and more particularly to an elevator door safety lock system, generally 30, which provides for that increased safety and security by ensuring that the elevator door 25 remains closed and/or locked when appropriate, even under certain unusual circumstances including power failures and/or interruptions. In this regard, the elevator system 10 of the present invention preferably includes an elevator shaft 15 and at least one elevator car 20. The elevator car 20 is structured to move within the shaft 15 between a plurality of floor openings 17 defined in the shaft 15. As a result, passengers or other materials may get on the elevator 20 and can appropriately ride to a desired floor opening 17, at which point they can exit the elevator 20. Along these lines, each elevator 20 preferably includes an elevator door 25 structured to maintain the elevator car 20 closed when it is traveling between floor openings 17. Furthermore, as with a typical elevator system, the elevator door 25 may be of one, two or multiple section construction and is preferably structured to effectively release a corresponding door at the floor opening 17 when it opens, so that passengers or cargo can enter and exit the elevator 20 in a conventional fashion.

In order to ensure that the door 25 on the elevator 20 is maintained closed when the elevator 20 is not aligned with a floor opening 17, an elevator door safety lock system 30 is preferably provided. In particular, the elevator door safety lock system 30 is structured to maintain the elevator door 25 locked in a closed position while the elevator is between floor openings 17, including both during movement between floor openings 17 as well as if stopped between floor openings 17. Conversely, when the elevator 20 becomes properly aligned with a floor opening 17, the elevator door safety lock system 30 is structured to unlock the elevator door 25, thereby allowing it to open in a normal fashion and allow appropriate entry and exit from the elevator 20.

Figure 3:
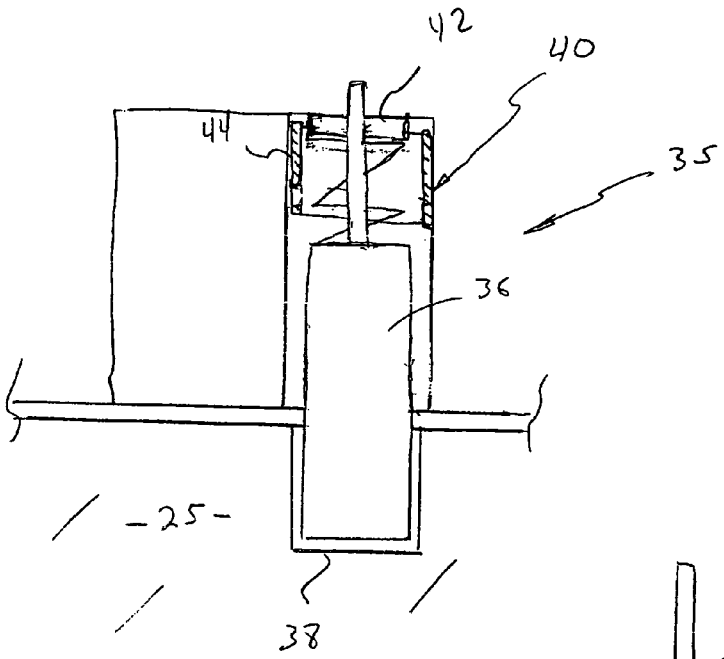
FIG. 3 is a detailed cross section view of a preferred door lock of the present invention with the engager disposed in its first state.
Figure 4:
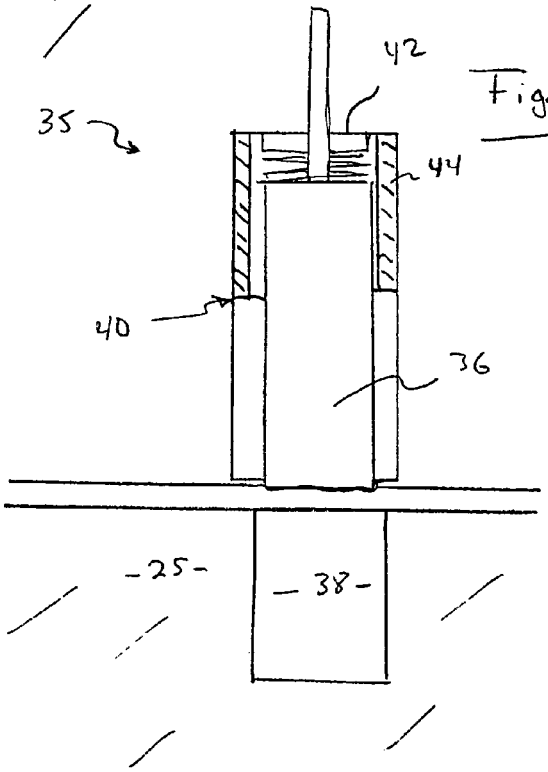
FIG. 4 is a detailed cross section view of the preferred door lock of the present invention with its engager disposed in its second state.

Included in the preferred embodiment of the elevator door safety lock system 30 of the present invention is a door lock 35 and a vertical position sensor. The door lock 35 maintains the elevator door 25 securely locked when the elevator 20 is not aligned with one of the openings 17, and the vertical position sensor identifies a vertical position of the elevator 20 within the shaft 15, and more precisely identifies when the elevator 20 is aligned or non-aligned with a floor opening 17. Looking first to the door lock 35, it preferably includes a socket 38 and a latch pin 36. In particular, the latch pin 36 is structured to move between an engaged and a disengaged orientation relative to the socket 38, thus serving to maintain the door 25 locked in a closed position when in its engaged orientation, as illustrated in FIG. 3, but to allow opening of the elevator door 25 when the latch pin 36 is in its disengaged orientation, as illustrated in FIG. 4. In the preferred, illustrated embodiment, the latch pin 36 is generally strong and rigid and is operatively associated with the elevator door 25, such as preferably by being mounted to and/or within the elevator door 25 or on top of the elevator as illustrated. The socket 38 is therefore defined and/or disposed within a confronting portion of the elevator or door, such as an underlying floor portion of the elevator 20 or embedded within the elevator door 25, in a generally aligned orientation with the location of the latch pin 36 when the elevator door 25 is in a closed orientation. Of course, it is understood that an inverse configuration with the socket 38 defined in the frame and the latch pin 36 defined in the door of the elevator may also be provided, as well as alternate positionings of the door lock 35 for both floor engagement and/or ceiling engagement and/or side wall engagement and/or any other positioning such that appropriate engagement between the latch pin 36 and the socket 38 is achieved and the elevator door 25 cannot be opened. Furthermore, because many elevators 20 can include a pair of door segments that open outwardly, it is recognized that multiple door locks 35 may be provided, one for each door segment, and/or one in the floor and one in the ceiling of a horizontally opening elevator door, or at one or both side edges of the elevator 20 in a vertical opening elevator door 25.

Looking in further detail to the illustrated embodiment of the door lock 35, it preferably includes an engager 40. Specifically, the engager 40 preferably includes a first state, such as that illustrated in FIG. 3, and a second state, such as that illustrated in FIG. 4. Specifically, the first state of the engager 40 is structured to maintain the latch pin 36 in its engaged orientation whereby the elevator door 25 is maintained locked in its closed position. Conversely, the second state of the engager 40 is preferably such that the latch pin 36 is maintained in its disengaged orientation relative to the socket 38, and the elevator door 25 is free to open. Significantly, however, the engager 40 of the preferred, illustrated embodiment of the door lock 35 is configured such that it will remain in a current state, either the first or second state, until such time as it receives an input, and only then will a change of state occur. This characteristic of the preferred engager 40 of the present invention is especially beneficial in that when the engager 40 places the latch pin 36 in its engaged orientation such that the elevator door is locked, an interruption in power or some other disconnection of the door lock 35 will not result in a change of state that will lead to the latch pin 36 moving to its disengaged orientation and unlocking the elevator door 25. Thus in the case of a power outage or otherwise, the elevator door 25 will remain locked unless it is in proper alignment with a floor opening 17 and was already unlocked by virtue of the latch pin 36 having been moved to its disengaged orientation. Along those lines, when the latch pin 36 is in the disengaged orientation and the engager 40 is in its second state, a similar interruption in power and/or disconnection, which would necessarily also lead to the elevator 20 no longer moving, will not result in unnecessary locking of the elevator door 25 even though it is aligned with a floor opening 17.

Looking in further detail to the preferred engager 40 of the present invention, it preferably includes a bi-stable solenoid. Furthermore, in the illustrated embodiment, the latch pin 36 may actually comprise a part of the engager or bi-stable solenoid 40. In at least one embodiment, the latch pin 36 comprises a steel material of construction which possesses material properties capable of magnetic interaction. Although other configurations are possible, the preferred bi-stable solenoid 40 is typically characterized in that it includes at least one permanent magnet 44. Furthermore, in typical operation of the bi-stable solenoid 40, the permanent magnet 44 is configured such that it can effectively maintain the latch pin 36 in its retracted and/or disengaged orientation, as illustrated in FIG. 4, the magnetic attraction of the permanent magnet 44 preferably being sufficiently strong to overcome any other outward pushing forces, such as a spring that may be included in some embodiments, if desired. In the preferred bi-stable solenoid 40, in order to provide for the effective movement of the latch pin 36 between its engaged and disengaged orientation, thus switching the bi-stable solenoid 40 between its first and second states, a variable polarity magnet 42 may also be provided to provide an initial pulling or pushing force. Typically, it is this secondary magnet 42 that receives a varying polarity microburst of electricity in order to energize it at a given desired polarity. Thus, in one polarity this secondary magnet 42 will have an attractive polarity that pulls in the latch pin 36 until the permanent magnet can maintain it in its disengaged orientation, and conversely when receiving a opposition polarity micro pulse will define a repulsive force that will push away the latch pin 36 out of the holding range of the permanent magnet 44. Accordingly, only when these inputs are received by the bi-stable solenoid 40 will a change of state occur, there being no continuous electrical input as may be the case with other traditional electronic latch mechanisms. Furthermore, this also provides that the door lock 35 of the present invention will have a substantially longer life as it will not be under a constant electrically driven input for extended periods of time, does not have the hum that is often associated with such constant electrical inputs, and requires much lower strength microbursts to effectively achieve the desired result, those small bursts often being producible by a battery. For example, in one embodiment, a microburst current pulse, used to reverse the polarity of the secondary magnet 42, lasts for about one-half second which prevents the bi-stable solenoid 40 from generating excessive heat.

In a still further embodiment, the door lock 35 comprises noise dampening components such as, but not limited to, cork sheeting and rubber washers. In addition, rubber mounting grommets are used in mounting the door lock 35 to the elevator 20.

As previously indicated, a vertical position sensor is also provided within the elevator door safety lock system 30 of the present invention, and preferably functions to cause the inputs to be communicated to the engager 40. In this regard, it may be preferred that the vertical position sensor directly generates the input to the engager 40, although it is understood that the vertical position sensor may also be configured to merely trigger an input being directed to the door lock 35 from another source. Furthermore, the input may be the same at all times, the vertical position sensor merely identifying when the elevator is aligned with a floor opening 17 or signaling when it has become non-aligned with the floor opening 17, or specific unique inputs may be provided, one type of input when alignment is achieved and another type of input when non-alignment is achieved. Also, it is noted that in the preferred embodiment the vertical position sensor is preferably configured to indicate the moment when the elevator 20 becomes non-aligned with the floor opening 17 and not necessarily to provide a constant indication that the elevator 20 is not aligned with the floor opening 17, the significant point within the preferred embodiments of the present invention typically being the time when the elevator 20 becomes non-aligned such that an appropriate input to trigger the locking of the elevator door 25 is communicated to the door lock 35. Conversely, when alignment is achieved, the vertical position sensor will cause an appropriate input to be communicated to the door lock 35 to unlock the elevator door. It is also noted that an elevator, when traveling through the shaft, will necessarily pass a number of floor openings 17, thus becoming temporarily aligned with each floor opening 17 as it passes it. As a result, if desired, a time delay characteristic may be built in such that a non-alignment with a floor opening 17 which is sufficient to trigger an input only results if the vertical position sensor has detected that the elevator 20 was previously aligned with the floor opening 17 for a predetermined period of time indicative of the fact that it had stopped on that floor. For example, in one embodiment, the time delay is adjustable within a range from about two hundredths of a second to about one full second in duration. Nevertheless, based upon the typical rate of travel of an elevator past each of the specific floor opening 17, and taking into account normal delays and/or reaction times of the vertical position sensor, and in particular the preferred embodiment of the vertical position sensor which is to be described, such a time delay is often not necessary as an insufficiently long alignment to trigger the input is typical as the elevator 20 is merely passing a floor opening 17. Accordingly, in one particular embodiment, a discrete jumper permits selection between enablement and disablement of the time delay capability.

Looking more in particular to the preferred embodiment of the vertical position sensor of the present invention, it preferably includes a radio frequency identification system or RFID system. In the preferred embodiment, the RFID system preferably includes at least one RFID reader 50, such as secured to the elevator 20 in any of a variety of locations, and one or more RFID tags 52 positioned, preferably within the elevator shaft 15 at specific locations so as to correspond to one or a plurality of floor openings 17. For example, even though it is noted a fewer number of RFID tags 52 as compared to floor openings 17 may be provided, including a single RFID tag of significant capacity disposed at one location with the RFID reader 50 merely measuring and/or being triggered by proximity changes to that tag, in the preferred embodiment a plurality of RFID tags 52 are provided, at least one RFID tag 52 disposed at each of the plurality of floor openings 17. When the RFID reader 50 comes into a predefined proximity to the RFID tag 52, the system "wakes up" and a signal is sent to the RFID reader 50 indicating that the RFID tag 52 is present and thus in that predetermined desired proximity, which, in the preferred embodiment, denotes alignment with a floor opening 17. Moreover, because an RFID system does not require a line of sight or contact communication, even if the RFID reader 50 or the RFID tags 52 become occluded or covered, they will still effectively operate to indicate when the elevator 20 is aligned with a floor opening 17 merely by virtue of being disposed at a specific, predefined proximity with one another. Furthermore, that proximity preferably relates to a directly aligned position therebetween, which should arguably be the closest distance between the two. For example, in one embodiment, the RFID reader 50 recognizes an RFID tag 52 when the respective components are within a distance of about six inches (6") of one another. Thus, when the RFID reader 50 and RFID tag 52 communicate, the RFID system is able to identify that the elevator 20 is properly aligned with the floor opening and can result in the corresponding input to be communicated to the door lock 35. Of course, even though possibly less desirable, it is recognized that the RFID tags 52 could also be positioned so as to be indicative that the elevator 20 is nonaligned with the floor opening 17, the absence of an RFID tag 52 within a predefined proximity resulting in the RFID reader 50 causing communication of an input to the door lock 35.

Finally, as an added benefit associated with installation of the vertical position sensor, and in particular with the installation of the RFID system, the RFID reader 50 may include one or a plurality of alignment indicators operatively associated therewith. Specifically, these alignment indicators may be mounted to the RFID reader 50 or may be able to be connected thereto. Accordingly, when an installer has positioned the RFID reader 50 on the elevator 20, they can easily place the tag 52 in a precise location within the shaft, as the alignment indicator, which may comprise a light or audible signal from a speaker or amplifier, is emitted by the RFID reader 50 to indicate that effective alignment has been achieved. For example, in one embodiment the alignment indicator comprises an LED. In another embodiment, the alignment indicator comprises an eighty five Decibel (85 dB) tone generator. This can significantly reduce installation and testing time while providing a significant amount of accuracy associated with alignment, which in turn provides a significant degree of accuracy in connection with indicating when the elevator 20 is aligned with a floor opening 17.

Figure 5:
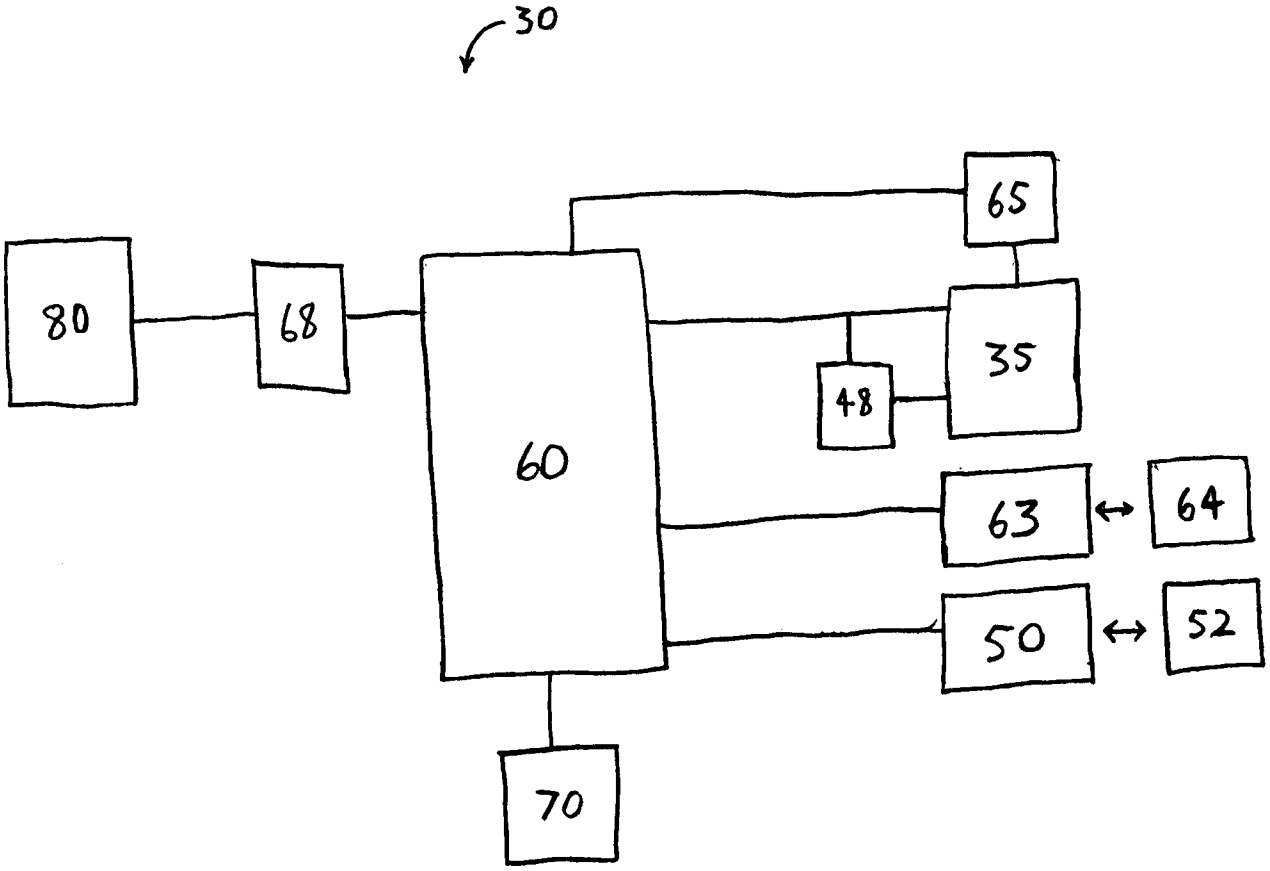
FIG. 5 is a schematic of another embodiment of an elevator door safety lock system.

With reference now to the schematic illustration of FIG. 5, another embodiment of the elevator door safety lock system 30 includes a control unit 60 structured to coordinate activity of the system 30. The system 30 also includes a power supply 70 which provides voltage and current for operation of the system 30. In at least one embodiment, the power supply 70 can operate with input ranging from 120 V AC to 220 V AC.

As seen in FIG. 5, the control unit 60 is structured to communicate with the RFID reader 50 as well as the door lock 35. More specifically, the control unit 60 is structured to send signals and/or instructions to, and receive signals and/or information from, both the RFID reader 50 and the door lock 35. For example, the control unit 60 can generate a signal to activate the door lock 35 into either the locked state or the unlocked state.

The control unit 60 is also in communication with an elevator controller 80. As such, the control unit 60 is capable of coordinating activities of the elevator door safety lock system 30 in cooperation with the elevator controller 80, which otherwise controls the operation of the elevator system 10. In a further embodiment, communication between the control unit 60 and the elevator controller 80 is facilitated by a dry interface contact 68. By way of example, in one embodiment, the dry interface contact 68 is isolated at 500 Volts.

The elevator door safety lock system 30 also includes an engagement sensor 48 in communication with the control unit 60 and structured to detect whether the door lock 35 is in a locked or unlocked state. More specifically, the engagement sensor 48 is structured to detect whether the orientation of the latch pin 36 is in either the engaged or disengaged state. For example, in one embodiment, the engagement sensor 48 comprises a micro switch which identifies whether the latch pin 36 is in the engaged or disengaged state. Accordingly, the control unit 60 can signal to the elevator controller 80 whether the elevator door 25 is locked or unlocked.

The system 30 also includes a release capability 65 in communication with the control unit 60 and structured to permit selectable release of the door lock 35. By way of example, in one embodiment, the release capability 65 comprises a momentary button switch which is pressed to activate the release of the door lock 35. The release capability 65 can be located in a variety of locations on, in, or about the elevator car 20, and can be used, for example, during inspections when the elevator is disposed between landings.

The system 30 further comprises a door monitor 63 in communication with the control unit 60, structured to monitor and signal whether the elevator door 25 is open or closed. In at least one embodiment, the door monitor 63 comprises a magnetic proximity sensor which detects the presence and/or absence of a magnetic slug 64 disposed on the elevator door 25, facilitating a determination of whether the elevator door 25 is open or closed. In a further embodiment, the control unit 60 receives input from the door monitor 63 as to the status of whether the elevator door 25 is open or closed, and subsequently signals the status to the elevator controller 80. This signal can be used to confirm the door open/closed status provided by a separate gate switch signal received by the elevator controller 80.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. To be installed on an elevator having a door and structured to travel within a shaft between multiple floor openings, an elevator door safety lock system, comprising:

a vertical position sensor structured to identify alignment of the elevator door with each of the multiple floor openings, said vertical position sensor comprising an RFID reader disposed on the elevator and movable therewith and a plurality of RFID tags, each disposed in the shaft in corresponding relation to different ones of the floor openings, said RFID reader structured to detect whether any one of said RFID tags is disposed within a predetermined proximity thereof, thereto enabling said vertical position sensor to recognize alignment achieved instantaneously when said RFID reader is within said predetermined proximity of one of said RFID tags and determine said elevator door is aligned with one of said floor openings when alignment achieved is recognized;

a door lock structured to maintain the door securely locked when the elevator door is not aligned with one of the floor openings;

said door lock including a socket and a latch pin, said latch pin structured to move between an engaged orientation and a disengaged orientation relative to said socket, said door lock operatively associated with the elevator door so as to maintain the elevator door in a closed position when said latch pin is in said engaged orientation;

said door lock further including an engager having a first state and a second state, said first state structured to maintain said latch pin in said engaged orientation and said second state structured to maintain said latch pin in said disengaged orientation, said engager structured to change engagement states, defined as a change from said first state to said second state or from said second state to said first state, only upon receipt of an input;

said engager structured to change engagement states through a provision of one or more microbursts of electricity;

said vertical position sensor structured to cause said input to be communicated to said engager upon determining said elevator door is aligned with one of said floor openings and upon said RFID reader moving from a position where said elevator door was aligned with one of said floor openings to a position where alignment achieved is not recognized, such that said engager is in said first state when alignment achieved is not recognized and in said second state when said elevator door is aligned with one of said floor openings;

a release capability structured to permit selectable manual release of said door lock; and a visual indicator structured to indicate when one of said RFID tag is within said predetermined proximity of said RFID reader.

2. An elevator door safety lock system as recited in claim 1 wherein:

said vertical position sensor includes a time delay capability which can be selectively enabled or disabled; and said time delay capability allows for said vertical position sensor to be adapted so that it determines said elevator door is aligned with one of said floor openings only when alignment achieved is recognized for a predetermined period of time.

3. An elevator door safety lock system as recited in claim 2, wherein the predetermined period of time required for it to be determined said elevator door is aligned can be lengthened or shortened.

4. An elevator door safety lock system as recited in claim 3, wherein the predetermined period of time required for it to be determined said elevator door is aligned is a specific period of time within a range of two hundredths of a second to one second.

5. An elevator door safety lock system as recited in claim 1, wherein said vertical position sensor is structured to cause said input which causes said engager to change engagement states only upon determining said elevator door is aligned with one of said floor openings and said RFID reader moving from a position where said elevator door was aligned with one of said floor openings to a position where alignment achieved is not recognized and the microbursts of electricity are the only inputs received by the engager.

6. An elevator door safety lock system as recited in claim 1, wherein said microburst of electricity is defined by a current pulse which lasts for one-half second.

7. An elevator door safety lock system as recited in claim 1, wherein said release capability requires continuous provision of manual actuation for said latch pin of the door lock to be held in a disengaged orientation.

8. To be installed on an elevator having a door and structured to travel within a shaft between multiple floor openings, an elevator door safety lock system, comprising:

a vertical position sensor structured to identify alignment of the elevator door with each of the multiple floor openings, said vertical position sensor comprising an RFID reader disposed on the elevator and movable therewith and a plurality of RFID tags, each disposed in the shaft in corresponding relation to different ones of the floor openings, said RFID reader structured to detect whether any one of said RFID tags is disposed within a predetermined proximity thereof, thereto enabling said vertical position sensor to recognize alignment achieved instantaneously when said RFID reader is within said predetermined proximity of one of said RFID tags and determine said elevator door is aligned with one of said floor openings when alignment achieved is recognized;

a door lock structured to maintain the door securely locked when the elevator door is not aligned with one of the floor openings;

said door lock including a socket and a latch pin, said latch pin structured to move between an engaged orientation and a disengaged orientation relative to said socket, said door lock operatively associated with the elevator door so as to maintain the elevator door in a closed position when said latch pin is in said engaged orientation;

said door lock further including an engager having a first state and a second state, said first state structured to maintain said latch pin in said engaged orientation and said second state structured to maintain said latch pin in said disengaged orientation, said engager structured to change engagement states, defined as a change from said first state to said second state or from said second state to said first state, only upon receipt of an input;

said engager structured to change engagement states through a provision of one or more microbursts of electricity;

said vertical position sensor structured to cause said input to be communicated to said engager upon determining said elevator door is aligned with one of said floor openings and upon said RFID reader moving from a position where said elevator door was aligned with one of said floor openings to a position where alignment achieved is not recognized, such that said engager is in said first state when alignment achieved is not recognized and in said second state when said elevator door is aligned with one of said floor openings;

a release capability structured to permit selectable manual release of said door lock; and an audible indicator structured to indicate when one of said RFID tags is within said predetermined proximity of said RFID reader.

* * * * *